US007311094B2

(12) United States Patent
Mallebrein et al.

(10) Patent No.: US 7,311,094 B2
(45) Date of Patent: Dec. 25, 2007

(54) METHOD FOR OPERATING AN INTERNAL COMBUSTION ENGINE

(75) Inventors: Georg Mallebrein, Korntal-Muenchingen (DE); Carlos Koster, Campinas (BR)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/554,007

(22) PCT Filed: Jan. 4, 2005

(86) PCT No.: PCT/EP2005/050015

§ 371 (c)(1),
(2), (4) Date: Oct. 11, 2005

(87) PCT Pub. No.: WO2005/080775

PCT Pub. Date: Sep. 1, 2005

(65) Prior Publication Data

US 2006/0201487 A1 Sep. 14, 2006

(30) Foreign Application Priority Data

Feb. 24, 2004 (DE) ..... 10 2004 008 891

(51) Int. Cl.
*F02D 41/14* (2006.01)

(52) U.S. Cl. ..... 123/698; 123/72 A; 123/572

(58) Field of Classification Search ..... 123/73 A, 123/698, 478, 572
See application file for complete search history.

(56) References Cited

U.S. PATENT DOCUMENTS

| | | | | |
|---|---|---|---|---|
| 4,794,889 | A * | 1/1989 | Hensel | 123/73 SC |
| 5,331,940 | A * | 7/1994 | Takayama | 123/679 |
| 5,546,918 | A * | 8/1996 | Mayer et al. | 123/674 |
| 5,555,858 | A * | 9/1996 | Katoh | 123/73 SC |
| 6,321,735 | B2 * | 11/2001 | Grieve et al. | 123/674 |
| 6,422,191 | B1 * | 7/2002 | Braun et al. | 123/184.21 |
| 6,959,692 | B2 * | 11/2005 | Song et al. | 123/406.45 |
| 2002/0139360 | A1 * | 10/2002 | Sato et al. | 123/698 |

FOREIGN PATENT DOCUMENTS

| | | |
|---|---|---|
| DE | 44 23 241 A1 | 1/1996 |
| JP | 63143374 | 6/1988 |
| JP | 10317936 | 12/1998 |

* cited by examiner

*Primary Examiner*—Erick Solis
(74) *Attorney, Agent, or Firm*—Michael J. Striker

(57) ABSTRACT

Operation of an internal combustion engine with oil lubrication and electronic fuel injection, includes the steps of determining a flow of fuel mass (mkp_ausg) evaporating out of oil, and determining a setpoint injected-fuel quantity (rk_ev) with taking into account the determined flow of fuel mass.

9 Claims, 2 Drawing Sheets

METHOD FOR OPERATING AN INTERNAL COMBUSTION ENGINE

BACKGROUND OF THE INVENTION

The present invention is directed to a method for operating an internal combustion engine.

During a cold start of an internal combustion engine, the temperatures of the walls of the intake port and the combustion chamber are markedly lower than the temperature that prevails during normal operation. A portion of the injected fuel condenses on the cold combustion-chamber walls and, initially, does not take part in combustion. Under these conditions, a significant quantity of the injected fuel is scraped into the oil by the piston rings, and a further quantity enters the exhaust-gas system, unburned. As the internal combustion engine and engine oil continue to heat up, the portion of fuel scraped into the oil evaporates into the oil, however, and is directed via crankcase ventilation into the intake manifold and enriches the air-fuel mixture.

To nevertheless ensure a good start, post-start phase and warm-up, a markedly greater quantity of fuel must be injected than is typical when the engine is warm. This excess fuel portion nearly corresponds to the quantity of fuel that is lost, unburned, in the exhaust gas and/or that enters the oil via the piston rings. In addition, the quantity of fuel added is a function not only of the temperature of the internal combustion engine, but also of engine speed and the torque required by the driver. The quantity of fuel added to the oil is therefore greatly increased, e.g., by a forced driving style. The quantity of fuel added also depends on the fuel type. For example, when alcohol is used instead of gasoline, it is observed that a markedly greater quantity of fuel is added that, even when the start temperatures are much higher than zero degrees Celsius, cannot be disregarded. In principle, the quantity of fuel added can be determined based on the evaporation behavior of the fuel. The poorer the fuel evaporation is at engine start-up temperatures, the greater the quantity of fuel is that condenses or remains fluid, and the greater the quantity of fuel is that must be injected.

To compensate for fuel condensation, with gasoline engines, an intervention in the mixture pilot control is carried out, for example, and a greater quantity of fuel is precontrolled, based on enrichment factors. As soon as the lambda closed-loop control is active, it can also adjust this quantity of fuel.

Although more fuel must be injected in the condensation phase when the engine is cold, as described above, the effect is reversed as the oil becomes increasingly hotter. The fuel contained in the oil then evaporates and is supplied to the combustion via crankcase ventilation. The injected-fuel quantity must now be reduced.

If the evaporation rate is low, it is sufficient for the lambda closed-loop control to compensate for this extra flow of fuel mass coming from evaporation that therefore supplements the injected-fuel quantity. It must be ensured, however, that, if there are strong deviations in the lamba closed-loop control, this is not interpreted to mean that a diagnostic fault exists. In particular, it has been demonstrated that, at idle and at operating points close to idle, the evaporation is much more pronounced than at high loads and engine speeds.

Publication DE 44 23 241 A1 makes known a learning closed-loop control method for adjusting the composition of the operating mixture for an internal combustion engine, with which the speed at which the additional interventions is learned is a function of temperature. By way of this method, the situation is prevented, among others, that the portion of gasoline evaporating out of the engine oil during the warm-up phase erroneously influences the mixture regulation. If the oil temperature has been above a threshold for long enough, it is assumed that the gasoline has evaporated, and the closed-loop control method returns to operation based on normal values again.

Furthermore, with injection systems that tolerate gasoline as well as alcohol, and a mixture of the two in any combination, and that adapt the mixture in the tank without an additional sensor—known as "fully adaptive flexible fuel systems"—the mixture adaptation is quasi maintained, when fuel evaporation takes place as expected, and the control stroke of the lambda closed-loop control system is expanded markedly in the downward direction.

SUMMARY OF THE INVENTION

In contrast, the method according to the present invention for operating an internal combustion engine has the advantage that the fuel flow evaporating out of the engine oil is also taken into account in the calculation of the injection time, during precontrol, in fact. This has the particular advantage that the mixture and control deviations in the lambda closed-loop control are reduced and, as a result, the mixture precontrol is improved markedly. In addition, fuel consumption and emissions are reduced, and driveability is improved. In addition, as a result of the reduced control deviations, erroneous fault detections in fuel supply system diagnostics are prevented.

It is particularly advantageous to determine a fuel mass flowing into the intake manifold based on the evaporating fuel mass flow and to correct the setpoint injected-fuel quantity with consideration for this flow of mass. As a result of this method, the accuracy of the setpoint injected-fuel quantity is improved further, thereby enabling a reliable, fuel-saving operation of the internal combustion engine.

Furthermore, it is advantageous to determine the quantity of fuel added to the engine oil while taking various influencing variables into consideration. Possible influencing variables include the different enrichment of the fuel quantity during start, a post-start phase and/or warm-up of an internal combustion engine, the engine temperature and/or a comparable component temperature, the oil temperature, the temperature in the intake port and/or in the combustion chamber, and the fuel type. Taking essential influencing variables into account advantageously increases the reliability of the fuel flow entering the engine oil to be determined.

According to another advantageous further development, at least one typical influencing variable is taken into account in the determination of the fuel mass flow evaporating out of the engine oil. Typical influencing variables include, e.g., the oil temperature, the course of oil temperature over time, the fuel mass in the oil at a particular instant, and/or the fuel type.

According to another advantageous further development, at least one of the typical influencing variables/parameters is taken into account in the determination of the fuel mass flowing into the intake manifold, such as the pressure in the crankcase, the pressure in the intake manifold, the pressure upstream of the throttle valve, the position of a crankcase ventilation valve, and the temperature of the engine oil and/or the blow-by gases.

According to another advantageous further development, the fuel mass contained in the engine oil can be determined by taking into account the inflowing and outflowing fuel masses. Based on the knowledge of the fuel mass contained in the engine oil, the further outflowing and inflowing fuel masses can be advantageously predicted and, e.g., the mixture precontrol can be adapted accordingly.

According to another advantageous further development, the flow of fuel mass evaporating out of the oil is converted into an equivalent injected-fuel quantity as a function of engine speed, this quantity then being substracted from an uncorrected setpoint flow of fuel mass and resulting in a corrected setpoint injected-fuel quantity. This method has the advantage that the fuel quantity that is evaporating at a particular instant is taken into account in the calculation of the injected-fuel quantity during precontrol itself, thereby resulting in a reduction in the necessary control intervention in the lambda closed-loop control; this results in a reduction in fuel consumption and emissions.

In a further advantageous manner, when there is an additional injection of a second fuel type (e.g., gasoline as the starting fuel for alcohol-based engine operation), a fuel mass in the oil is calculated for the fuel type that was also injected.

In a particularly advantageous manner, the methods for determining a setpoint injected-fuel quantity based on an evaporating fuel mass flow and/or a fuel mass mkp_saugr flowing into the intake manifold are programmed in a control unit for the operation of an internal combustion engine, so they can be applied.

Further features, possible applications and advantages of the present invention result from the description of exemplary embodiments of the present invention, below, the exemplary embodiments being depicted in the drawing. All of the features that are described or depicted, either alone or in any combination, are the subject of the present invention, independent of their wording in the claims or their backward reference, and independent of their wording and/or depiction in the description and the drawing.

DESCRIPTION OF THE PREFERRED EMBODIMENTS

Using the method according to the present invention, a setpoint injected-fuel quantity rk_ev is determined with consideration for a flow of fuel mass evaporating from the engine oil mkp_ausg and/or a fuel mass flowing into the intake manifold mkp_saugr.

Figure 1:
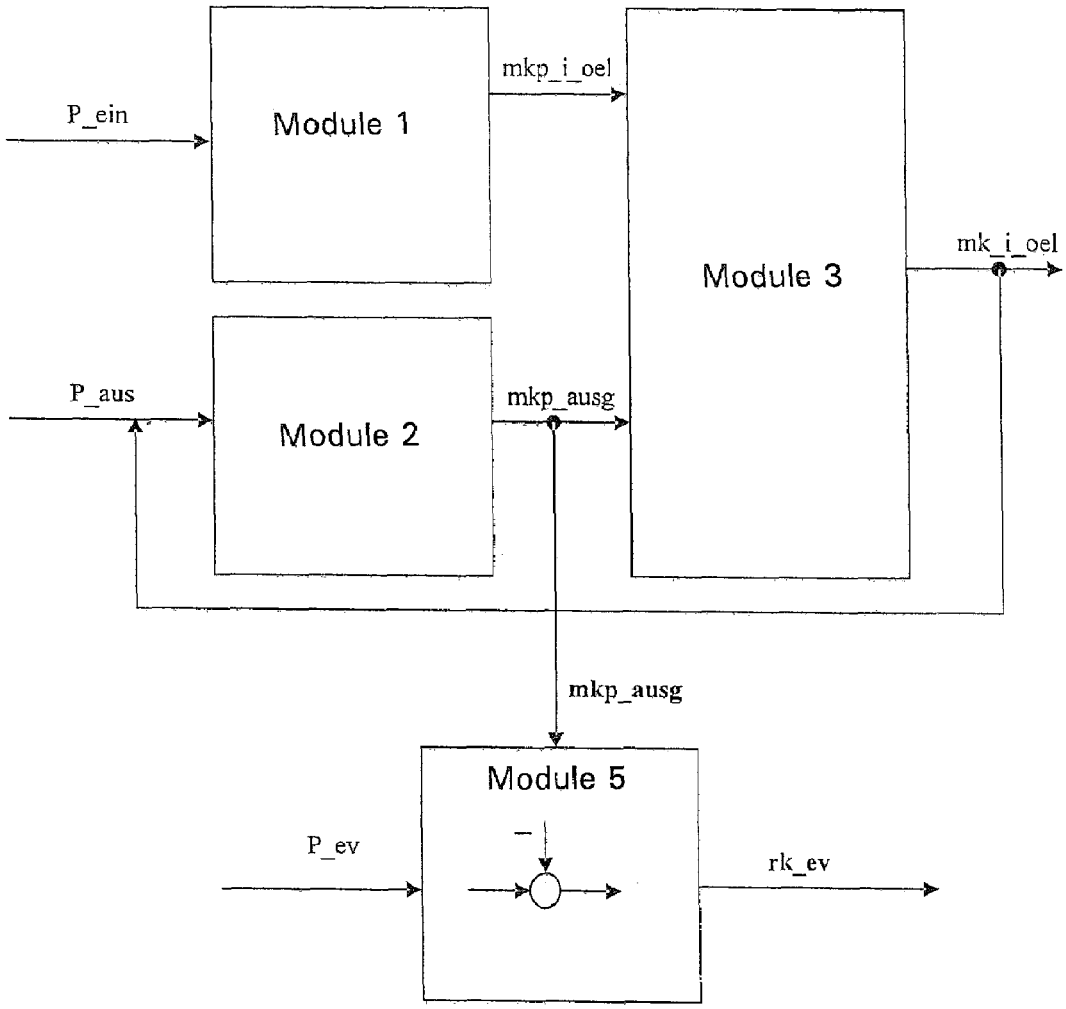
FIG. 1 shows a fundamental flow chart of the method according to the present invention.
Figure 2:
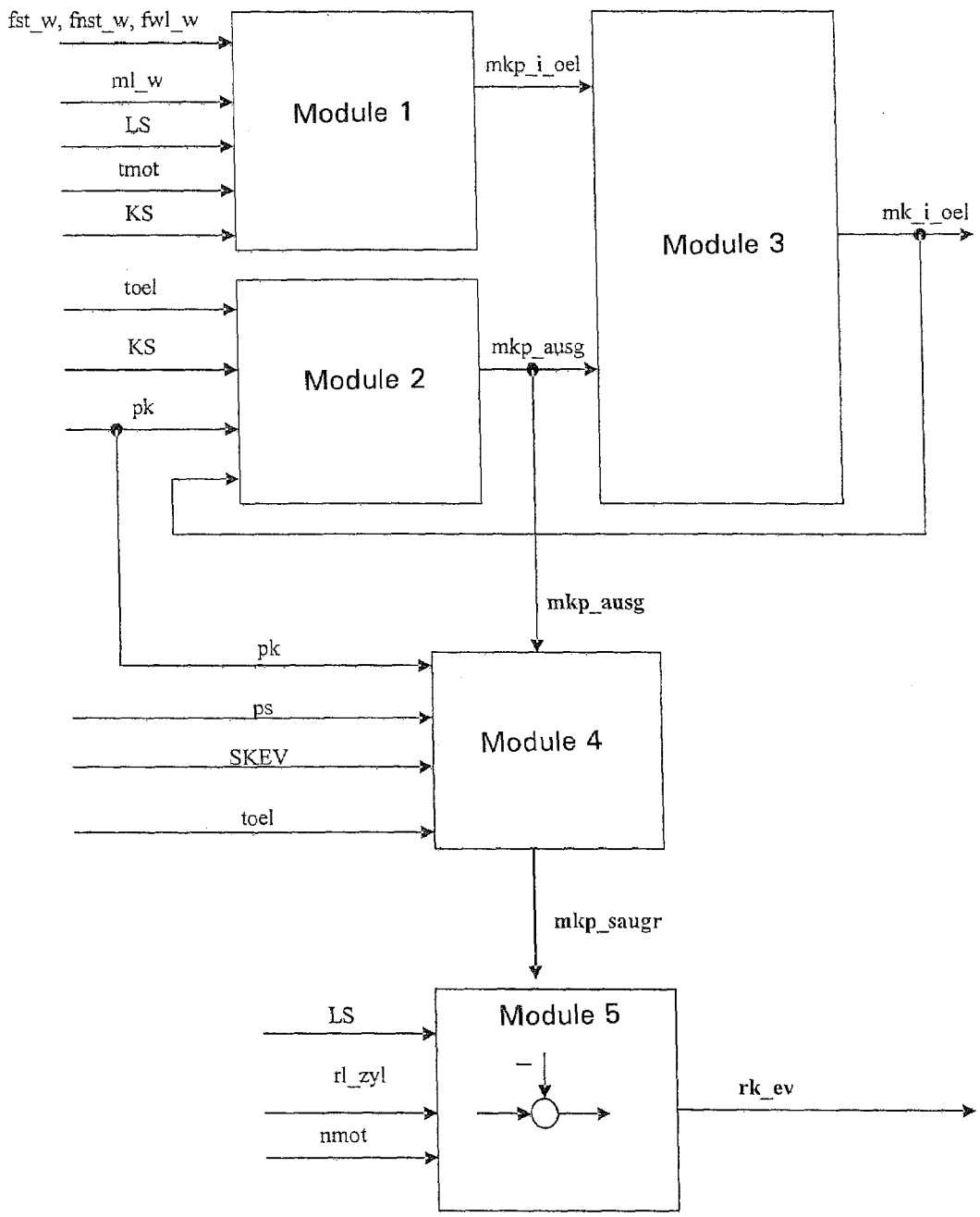
FIG. 2 shows a flow chart of an exemplary embodiment according to the present invention.

The method for determining the fuel evaporating from the oil and/or flowing into the intake manifold can be broken down into three basic sub-blocks:

a) Determine the quantity of fuel added to the engine oil during a cold start, a post-start phase and warm-up (module 1, FIGS. 1, 2);

b) Determine the quantity of fuel evaporating out of the engine oil (module 2, FIGS. 1, 2);

c) Sum total of the quantities of fuel that were added and that evaporated (module 3, FIGS. 1, 2).

The starting point for determining the flow of fuel mass added to the oil mkp_i_oel is the quantity of fuel injected "in excess". "In excess" refers to the (excess) quantity of fuel injected at cold start and warm-up in addition to the quantity of fuel that is common for normal operation to ensure faultless operation of the internal combustion engine. The excess quantity of fuel does not take part in combustion, and a percentage thereof enters the engine oil and the exhaust-gas system. The percentage that enters the oil or the exhaust-gas system depends to a great extent on the engine temperature or typical component temperatures in the combustion chamber. The percentage also depends on the fuel type, e.g., gasoline, alcohol, etc., and the mixing ratios thereof.

This (excess) quantity of fuel and/or enrichment fuel mass mk_anreich can be determined, e.g., via so-called start, post-start phase and/or warm-up enrichment factors and application factors fst_w, fnst_w, fwl_w a function of an air mass mk_verb required for combustion, the relationship being described as follows:

$$mk_\text{anreich}=mk_\text{verb}*(fst_w*fnst_w*fwl_w-1)$$

At first approximation, it can be assumed that a portion of this (excess) fuel quantity enters the engine oil and, once a certain engine oil temperature toel has been reached, it evaporates.

The quantity of fuel contained in the oil at a particular instant can be determined based on the sum total of the flow of mass of fuel entering the oil and evaporating from the oil, e.g., by integrating the difference of the two mass flows.

In principle, more fuel evaporates out of the engine oil as the temperature rises. The evaporating fuel quantity and/or the evaporating fuel mass flow mkp_ausg depends substantially on the quantity of fuel dissolved at that instant in the oil mk_i_oel, the fuel type KS and the oil temperature at that instant. The course of the oil temperature over time and the absolute pressure in the crankcase ck are also significant.

Basically, the evaporating fuel mass flow mkp_ausg increases, the more fuel there is dissolved in the oil. The boiling behavior of the fuel is the determining factor here. Gasoline has a wide boiling range and evaporates in a temperature range from 40° C. to approximately 120° C. Alcohol, on the other hand, has a boiling point at a temperature of approximately 70° C. At a temperature of 70° C., the alcohol dissolved in the oil boils very quickly, while the evaporation that takes place at temperatures below 70° C. is nearly negligible. A further important point is that, the faster the oil heats up, the more fuel that evaporates out of the oil, since the rapid temperature increase means that the boiling range is traversed faster and/or the boiling point is exceeded more quickly.

Since the boiling behavior also depends directly on pressure, the absolute pressure in the crankcase pk must also be taken into account in determining an evaporating fuel mass flow mkp_ausg.

The fuel partial pressure that becomes established as the fuel evaporates is only one of the parameters to be taken into account here. Further parameters depend on the operating state of the internal combustion engine and the design of the crankcase.

Crankcases are typically ventilated via a ventilation line into the intake-manifold region. The outlet of the ventilation line can preferably be located in the vicinity of the throttle valve, either downstream and/or upstream. If the outlet of the ventilation line is located downstream of the throttle valve, an intake manifold pressure ps exists at the outlet. If the outlet of the ventilation line is located upstream of the throttle valve, an atmospheric pressure pu typically exists at the outlet. If the ventilation line outlet is located simultaneously upstream and downstream of the throttle valve, then a combination of atmospheric pressure pu and intake-manifold pressure ps exists.

The pressure in the crankcase pk also depends on "blow-by". "Blow-by" is understood to be the quantity of gas that passes by the piston rings and enters the crankcase during operation of the internal combustion engine, in particular during the combustion cycle of a cylinder. Blow-by is essentially exhaust gas that, together with the evaporating fuel, contributes to pressure build-up in the crankcase.

According to the present invention, the crankcase and/or ventilation line can also be provided with a ventilation valve, the opening and closing of the ventilation valve typically taking place as a function of various operating conditions of the internal combustion engine. When the valve is closed, the pressure in the crankcase increases, of course. As a result of this pressure increase, in particular due to blow-by gases, the percentage of fuel evaporating out of the engine oil decreases, however, so that, when the valve opens, it is essentially the blow-by gases that first flow, with a small concentration of fuel, into the intake manifold. Since, when the pressure equalizes due to the crankcase ventilation valve being open and a high flow of mass, as gas, first flows into the intake manifold, the quantity of fuel increases.

To achieve a good compensation for the fuel evaporating out of the oil, a model must be defined for the concentration of fuel vapor in the crankcase and the dynamics of the mass flowing into the intake manifold. Only then can the injected-fuel precontrol quantity be corrected sufficiently well, even when a ventilation valve is used.

If the ventilation valve remains open, low pressure forms in the crankcase, which results in greater evaporation of fuel out of the oil and, as a result of this, the fuel mass flowing into the intake manifold also increases in a fixed manner. The conditions that result substantially correspond to the conditions in a crankcase without a ventilation valve.

In the case of a crankcase with a ventilation valve, not only must the influence mentioned initially therefore be taken into account to determine the fuel mass flowing into the intake manifold, but also, in particular, the triggering of the ventilation valve.

The geometry of the ventilation line and the valve is also significant in terms of the pressure that becomes established in the crankcase pk. The minimum cross section and length of the ventilation line are particularly significant.

In summary, the flow of fuel mass mkp_ausg evaporating from the engine oil into the crankcase depends on the quantity of fuel contained in the engine oil at a particular instant, the oil temperature at a particular instant—to which the fuel temperature and the temperature of the gases in the crankcase also substantially adjust—the gradient of the oil temperature, i.e., the course of the oil temperature over time, the fuel type KS and the gas pressure in the crankcase pk.

A basic flow chart of the method according to the present invention is shown in FIG. 1.

In module 1, a flow of fuel mass mkp_i_oel entering the oil is determined based on parameters P_ein, which are relevant for the addition of fuel to the oil. In module 2, a flow of fuel mass evaporating out of the oil mkp_ausg is determined based on parameters P_aus, which are relevant for the evaporation of fuel. Based on the sum total of the mass flow rates determined in modules 1 and 2, the fuel mass contained in the oil mk_i_oel is determined, this mass being integrated in the influencing variables P_aus that are relevant to evaporation. In module 5, a corrected setpoint injected-fuel quantity rk_ev is determined based on parameters P_einspr, which are relevant for injection, and based on the evaporating fuel mass flow mkp_ausg that was determined.

For the addition of fuel to the oil, the oil temperature toel and the engine load must be taken into consideration in particular as the parameters that are particularly relevant for the fuel addition P_ein. Additional important variables include: Engine temperature tmot, engine speed nmot, air mass m1_w—also as an alternative to engine speed and engine load—, setpoint value assignment for the lambda closed-loop control LS, fuel types and/or the enrichment factors at start, in the post-start phase, warm-up fst_w, fnst_w, fwl_w. Depending on these and other variables, the percentages of fuel that enter the oil and which percentages enter the exhaust gas are also determined.

For fuel evaporation, the relevant parameters P_aus to be taken into consideration in particular are the oil temperature toel and the fuel mass contained in the oil mk_i_oel. Also relevant are the pressure in the crankcase pk and, if applicable, the position of a crankcase ventilation valve SKEV.

In a first approximation it can be assumed that the (excess) fuel quantity that was injected in excess during the first phase of a cold start of an internal combustion engine was enriched to a certain extent in the engine oil and, when the oil temperature reached an adequate level, it evaporated. The (excess) quantity of fuel at start-up is calculated primarily based on the enrichment factors at cold start, in the post-start phase, and the warm-up phase fst_w, fnst_w, fwl_w, the lambda setpoint value assignment LS and the supplied air mass ml_w, which preferably corresponds to the product of engine load and engine speed.

These interdependencies can be modelled in advance, for example, and stored in program maps in a control unit in a suitable manner, so that, during operation of the internal combustion engine, the evaporating fuel mass flow mkp_ausg can be determined for every instant of operation, and can be taken into account in the determination of the corrected setpoint injected-fuel quantity rk_ev.

FIG. 2 shows a flow chart of an exemplary embodiment according to the present invention with which the conditions in the crankcase and the evaporation of the gases in the crankcase in the direction of the intake manifold, in particular, are also taken into account. By taking the conditions in the crankcase into account, a fuel mass flow entering the intake manifold mkp_saugr can be determined based on the evaporating fuel mass flow mkp_ausg, and the injected-fuel quantity can be more precisely corrected toward a setpoint injected-fuel quantity rk_ev. The main difference between FIG. 2 compared to FIG. 1 is the addition of module 4. This module is required, in particular, when a crankcase ventilation valve is used (position SKEV).

Knowledge of the quantity of fuel contained in the oil mk_i_oel at a particular instant is required to determine the evaporating fuel mass flow mkp_ausg, this quantity being determined from the sum total of the fuel mass flow being added to and evaporating out of the oil mpk_i_oel, mkp_ausg.

The fuel mass flow into the oil mkp_i_oel is calculated in module 1 with consideration for the enrichment factors at start, in the post-start phase, and warm-up fst_w, fnst_w, fwl_w, the fresh air mass flow into the combustion chamber ml_w, the setpoint value assignment for the lambda closed-loop control LS, the engine temperature tmot and/or comparable component temperatures, and the fuel type KS. The flow of fuel mass being added to the oil mkp_i_oel that was calculated is sent to module 3 for further calculations.

The fuel mass flow being added to and evaporating from the oil mkp_ausg is calculated in module 2 with consideration for the oil temperature toel, the fuel type KS, the pressure in the crankcase pk, and the fuel mass contained in the oil mk_i_oel. The evaporating fuel mass flow mkp_ausg that was calculated is sent to module 3 for further calculations, and to module 4 for calculation of the fuel mass flow mkp_saug flowing into the intake manifold at that particular instant.

The fuel mass mk_i_oel contained in the oil is calculated in module 3 based on the fuel mass flowing into and evaporating from the oil mkp_i_oel, mkp_ausg determined in modules 1 and 2. The fuel mass mk_i_oel contained in the oil, in turn, serves as the input variable for module 2 to calculate the evaporating fuel mass flow mkp_ausg. At the beginning of a start procedure, it is assumed that the oil contains no fuel.

In module 4, a mass flowing into the intake manifold mkp_saugr is determined based on the fuel mass flow evaporating out of the oil. To this end, the pressure in the crankcase pk, the pressure in the intake manifold ps, the oil temperature toel and, in the case of crankcases with a ventilation valve, the position of a crankcase ventilation valve SKEV are taken into account in particular.

In module 5, an (uncorrected) setpoint injected-fuel quantity is preferably determined with reference to the setpoint value assignment for the lambda closed-loop control LS, the fresh air charge in the cylinder rl_zyl. With consideration for the fuel mass flowing into the intake manifold mkp_saugr that was determined, and the engine speed nmot, the injection quantity called for based on the fuel evaporating is calculated and subtracted from the uncorrected setpoint injected-fuel quantity. The result is the corrected setpoint injected-fuel quantity rk_ev, which is then corrected based on further variables (e.g., lambda control factor) and forwarded to the injection output.

In the simplified embodiment (FIG. 1), it can be provided that, in the determination of a setpoint injected-fuel quantity rk_ev in module 5, it is not the fuel mass flowing into the intake manifold mkp_saugr that is taken into account, but rather the fuel mass flow evaporating out of the oil mkp_aus. The advantage of this is that data are easily obtained that allow an injection quantity rk_ev to be adapted in a suitable manner. This is particularly practical when a crankcase ventilation valve is not installed and the pressure in the crankcase remains largely uniform at the level of atmospheric pressure, due to the design of the ventilation bores.

Basically, when influencing variables are taken into account in module 4, the fuel mass flowing past the crankcase ventilation valve depends substantially on the valve position SKEV, the pressure conditions ps and pk and the oil temperature, which represents the temperature of the fuel gas, and/or the temperature of the gases in the crankcase.

The following applies: mkp_saugr=MSN (crankcase ventilation valve)*p_Kurbelgeh/1013 hPa*square root (273° K./toel)*outflow characteristic (ps/p_Kurbelgeh)*concentration of fuel vapor in the free gas volume of the crankcase.

The formula contains the flow equation that is applied, e.g., at the throttle valve. MSN is the normalized, supercritical flow of mass at 0° C. and 1013 mbar.

In a further embodiment, it is feasible to also take the dynamic behavior of the fuel mass flowing into the intake manifold into account with the aid of module 4, as a function of the pressure gradient in the crankcase pk.

As an alternative to the direct application of cold start, post-start phase and warm-up application factors and/or enrichment factors, it is also possible to model the fuel mass that enters the oil upon cold start and during the subsequent warm-up phase. The important influencing factors are:

Engine temperature (tmot) and/or oil temperature (toel)
Engine speed (nmot)
The load value (rl)
The component temperature in the intake port
The temperature in the combustion chamber
The fuel type (KS)
The assignment of the lambda setpoint value (LS)

In the case of systems with additional starting fuel injection, e.g., systems that use alcohol as fuel, or flexible-fuel systems, another addition of fuel can be advantageously calculated as a function of engine temperature and the additional quantity of injected fuel.

Reference Notation

MSN Normalized, supercritical flow of mass through an orifice/valve gap (high-pressure side: 1013 mbar, 273° K-0° C.)
fst_w Enrichment factor at start-up
fnst_w Enrichment factor in the post-start phase
fwl_w Enrichment factor during warm-up
KS Fuel type
LS Setpoint value assignment for lambda closed-loop control
mkp_i_oel Flow of fuel mass added to the oil during start, in the post-start phase, and during warm-up
mkp_ausg Flow of fuel mass evaporating out of the oil
mk_j_oel Fuel mass in the oil
mkp_saugr Flow of fuel mass flowing out of the crankcase and into the intake manifold
ml_w Flow of fresh air mass into the combustion chamber
nmot Engine speed
pk Pressure in the crankcase
ps Intake manifold pressure
rl_zyl Fresh air charge in the cylinder
rk_ev Corrected setpoint injected-fuel quantity (pure pilot control)
SKEV Position of crankcase ventilation valve
tinot Engine temperature and/or typical component temperature in the combustion chamber
toel Oil temperature

What is claimed is:

1. A method for operating an internal combustion engine with oil lubrication and electronic fuel injection, the method comprising the steps of determining during operation of the internal combustion engine a flow of fuel mass (mkp_i_oel) entering an engine oil; determining a flow of fuel mass (mkp_ausg) evaporating out of oil; and determining a setpoint injected-fuel quantity (rk_ev) with taking into account the determined flow of fuel mass (mkg-ausg) revaporating out of oil.

2. A method as defined in claim 1; and further comprising determining a flow of fuel mass (mkp_ausgr) flowing into an intake manifold based on the determined flow of fuel mass evaporating out of the oil (mkp_saug); and taking the determined flow of fuel mass flowing into the intake manifold in the determination of the setpoint injected-dual quantity (rk_ev).

3. A method as defined in claim 1; and further comprising determining to the flow of fuel mass (mkp_i_oel) taking into account at least one of the following influencing variables:

Enrichment factors during start, a post-start phase, and/or warm-up (fst_w, fnst_w, fwl_w) of the internal combustion engine
Engine temperature (tmot) and/or oil temperature (toel)
Engine speed (nmot)
Load value (rl)
A component temperature in the intake port
Temperature in the combustion chamber
Fuel type (KS)
An assigned lambda setpoint value (LS).

4. A method as defined in claim 1; and further comprising in the determining of the flow of fuel mass (mkp_ausg), evaporating out of the engine oil, taking into account at least one of the following influencing variables:

Oil temperature (toel)
Oil temperature gradient over time
Fuel mass in the oil (mk_i_oel)
Fuel type (KS)
Pressure in the crankcase (pk).

5. A method as defined in claim 1; and further comprising, in the determining of the flow of fuel mass (mkp_ausg) entering the intake manifold, taking into account one of the following influencing variables:

Pressure in the crankcase (pk)
Pressure in the intake manifold (ps)
Pressure upstream of a throttle valve (pu)
Position of a crankcase ventilation valve (SKEV)
Temperature of the engine oil (toel)
Concentration of the fuel gases in the crankcase due to blow-by gases.

6. A method as defined in claim 1; and further comprising determining a fuel mass (mk_i_ocl) contained in an engine oil, by taking into account a flow of fuel mass (mkp_i_oel, mkp_ausg) entering the engine oil and evaporating out of the engine oil.

7. A method as defined in claim 2; and further comprising converting a value selected from the group consisting of the flow of fuel mass (mkp_saugr) flowing into the intake manifold or the flow of fuel mass (mkp_ausg) during evaporation, as a function of an engine speed, into an equivalent injected-fuel quantity; and substracting from an uncorrected setpoint injected-fuel quantity, with a result being a corrected setpoint injected-fuel quantity rk_ev.

8. A method as defined in claim 1; and further comprising, if a second fuel type is also injected, calculating a fuel mass in the oil for the fuel type that was also injected.

9. A control unit for an internal combustion engine, the control unit is configured and programmed for use with a method for operating an internal combustion engine with oil lubrication and electronic fuel injection, the method comprising the steps of determining during operation of the internal combustion engine a flow of fuel mass (mkp_i_oel) entering an engine oil; determining a flow of fuel mass (mkp_ausg) evaporating out of oil; and determining a setpoint injected-fuel quantity (rk_ev) with taking into account the determined flow of fuel mass (mkp_ausg) evaporating out of oil.

* * * * *